US006571691B1

(12) United States Patent
Jones

(10) Patent No.: US 6,571,691 B1
(45) Date of Patent: Jun. 3, 2003

(54) APPARATUS FOR TIEING AND BINDING BALES OF MATERIAL

(75) Inventor: Samuel E. Jones, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/562,224

(22) Filed: Apr. 28, 2000

(51) Int. Cl.[7] ..... B65B 13/04

(52) U.S. Cl. ..... 100/26; 100/29; 100/3; 248/354.5; 248/289.11

(58) Field of Search ..... 100/26, 7, 29, 100/3, 30, 32, 33 R, 33 PB, 25, 31; 53/589; 248/291.1, 649, 677, 188.2, 652, 653, 664, 354.5, 289.11

(56) References Cited

U.S. PATENT DOCUMENTS

| | | | | |
|---|---|---|---|---|
| 1,650,810 A | * | 11/1927 | Weaver | 254/133 R |
| 2,814,394 A | * | 11/1957 | Witcher | 254/124 |
| 3,727,965 A | | 4/1973 | Cranston, III et al. | |
| 3,782,772 A | | 1/1974 | Cranston, III et al. | |
| 3,999,476 A | * | 12/1976 | Thompson | 100/7 |
| 4,018,146 A | * | 4/1977 | Evans | 100/26 |
| 4,193,627 A | | 3/1980 | Cranston et al. | |
| 4,403,542 A | | 9/1983 | Lewis | |
| 4,416,480 A | | 11/1983 | Moody | |
| 4,462,627 A | | 7/1984 | Kudlicka | |
| 4,565,399 A | | 1/1986 | Cranston | |
| 4,611,534 A | | 9/1986 | Kudlicka et al. | |
| 4,697,510 A | | 10/1987 | Cranston, III et al. | |
| 4,785,154 A | | 11/1988 | Moody | |
| 5,505,067 A | | 4/1996 | Thomas et al. | |

* cited by examiner

*Primary Examiner*—Rinaldi I. Rada
*Assistant Examiner*—Thanh Truong
(74) *Attorney, Agent, or Firm*—Wood, Herron & Evans, LLP

(57) ABSTRACT

A wire tieing system for wrapping and tieing a bale of material with wire comprises a wire guide for guiding a wire around a bale of material and a tieing head configured for receiving portions of a wire in the guide and securing the portions together to thereby tie the wire and therefore tie a bale of material. The tieing head is pivotable with respect to the wire guide and is operable for being pivoted between an operating position proximate the guide and a maintenance position away form the guide. A head pivot assembly maintains the tieing head in the maintenance position. The head pivot assembly comprises a support block and a locating pin which are operably movable to engage a portion of the tieing head when the tieing head is pivoted to the maintenance position to prevent the head from pivoting back to the operating position.

20 Claims, 4 Drawing Sheets

APPARATUS FOR TIEING AND BINDING BALES OF MATERIAL

FIELD OF THE INVENTION

The present invention relates to tieing or binding bales of compressed material. Specifically, the invention relates to an apparatus for tieing and securing wires or other binding devices wrapped around such bales, which apparatus may be easily serviced and maintained.

BACKGROUND OF THE INVENTION

Various types of bulk materials are shipped, stored, and otherwise processed and distributed in the form of bales. For example, recyclable materials, such as paper, plastic and metal are formed into bales for easier handling. Bulk material such as cotton might also be processed into compressed bales. Formed bales are easier and more efficient to handle than loose bulk material. Furthermore, bales are more organized and take up less storage or shipping space than loose material.

In a baling process, the loose material is collected and formed into a bale. After the bales of material are formed into the proper shape, they are usually wrapped or otherwise fitted with a structure which will keep them in the desired bale shape. For example, it is generally known to wrap bales of compressible material with wire or some other elongated binding device to keep the bales in their form for shipping and storage. Wire is preferable because or its strength, low cost, and the ease with which it is handled.

One method of forming a bale directs the compressible material into an automatic baler where it is pressed into a bale by a ram and then moved by the ram through the baler. At a certain position along the baling path, the bale is tied or bound together with wire. More specifically, a tieing system is used with the baler and guides a continuous wire strand around the bale to surround the bale as it progresses through the baler. The wire is overlapped when it completely surrounds the bale. The tieing system engages the bale and the overlapped wire and ties the wire around the bale.

In one system, a tieing head associated with the tieing system engages the overlapped wire and twists together the overlapped ends of the wire strands to secure the wire in place around the bale. The tieing head generally comprises a rotating pinion which has a slot to receive the overlapped wire ends. When the pinion is rotated, the wire ends are twisted together. Examples of various automatic balers and tieing methods are illustrated in U.S. Pat. Nos. 4,120,238; 4,155,296; 4,167,902, and 4,459,904.

Tieing systems for tieing wire around bales often need maintenance or other attention, such as to repair or replace an inoperable part in the system. However, existing wire tieing systems are sometimes difficult and time consuming to maintain. For example, some existing tieing systems incorporate a continuous wire guide through which the bale passes and a tieing head coupled to the guide and very close to the guide so that the wire in the guide may be tied. The guide and head are mounted on a frame which is then mounted to a baler. When it is necessary to service or otherwise maintain the guide or head with existing systems, the guide, head or other part of the system often has to be disassembled. The close spacing of the guide and tieing head and the overall tight construction of the system requires such disassembly, such as when it is necessary to work on the tieing head. As may be appreciated, disassembly of the system for maintenance and repair is time consuming and therefore costly. Not only are labor costs involved, but repair also means that the baling system is shut down. Therefore, existing system are not as efficient as desired when repairs are necessary.

Furthermore, safety is an issue as well where maintenance or repair is involved. For example, various components of existing tieing systems are large and heavy due to the fact that they are usually fabricated of steel or some other metal. A tieing head alone for such system may weigh several hundred pounds. Therefore, when disassembling or maintaining such systems, care must be taken to remove or otherwise secure any parts which may inadvertently and undesirably fall or move during the maintenance procedure.

Therefore, there is a need for a mechanism which ties and secures a wire or other similar binding device around a bale of compressed material and which may be readily and cost-effectively maintained or repaired.

It is another objective of the present invention to reduce the amount of disassembly of a system that is required for maintenance and repair.

It is another objective of the present invention to provide a tieing system in which the tieing head is readily accessible for repair and maintenance.

It is still another objective to provide for safe maintenance and repair of a wire tieing system.

These and other objectives will become more readily apparent from the Summary of the Invention and Detailed Description set forth hereinbelow.

SUMMARY OF THE INVENTION

A wire tieing system in accordance with the principles of the present invention is utilized to wrap and tie a bale of material with wire. The system comprises a wire guide for guiding the wire around a bale of material and a tieing head configured for receiving portions of wire in the guide and securing the portions together to tie the wire, and therefore, tie a bale of material. Generally the tieing head is mounted at the top or proximate the wire guide. The apparatus is used with a baling device of suitable construction.

In accordance with one aspect of the present invention, a tieing head assembly has a tieing head which is pivotable with respect to the wire guide. The tieing head alternately pivots between an operating position and a maintenance position. In one embodiment, the head is manually moved between the alternating positions. In the operating position, the head will generally be proximate the wire guide to engage the wires being passed through the guide so that the head may tie the wires. In the maintenance position, the tieing head is pivoted generally away from the guide. In the maintenance position, better access to the tieing head is provided to a maintenance person for maintaining and/or repairing the system, including the tieing head.

In accordance with one aspect of the present invention, the tieing head assembly includes a head pivot assembly which is operable, when the tieing head assembly is in the maintenance position, for preventing the tieing head from pivoting back to the operating position. In one embodiment of the invention, a support block is slidable beneath a portion of the tieing head. The support block lays underneath the bottom edge of the tieing head and prevents the head from pivoting back to the operating position. That is, the support block maintains the tieing head in the upwardly pivoted maintenance position. Therefore, the support block may be slid underneath the upwardly pivoted tieing head for maintenance purposes, and may be slid back away from the tieing head so that the head may return to the operating position to tie wires.

In accordance with another aspect of the present invention, the support block further comprises a pin which is operable to engage an aperture within the tieing head to lock the head in the operating position and to prevent it from being inadvertently pivoted to the maintenance position during a wire tieing operation.

In accordance with still another aspect of the present invention, a locating pin is operably mounted to engage the tieing head when it is pivoted to the maintenance position to further prevent head from pivoting back to the operating position. Preferably, the locating pin is spring loaded so as to automatically engage the tieing head when it is pivoted. In one embodiment, the tieing head includes a maintenance aperture and the locating pin is movable for sliding into the maintenance aperture when the head is in the maintenance position to further prevent the head from pivoting to the operating position. Furthermore, the tieing head includes an operating aperture and the locating pin is movable for sliding into the operating aperture to secure the head in the operating position and to prevent it from pivoting to a maintenance position. Therefore, the support block and locating pin are both utilized to maintain the head in the upwardly pivoted maintenance position in accordance with one aspect of the present invention, and are also utilized to lock the head in the downwardly pivoted operating position, in accordance with another aspect of the present invention.

Various features and advances of the invention will become more readily apparent from the Detailed Description hereinbelow.

BRIEF DESCRIPTION OF THE FIGURES

The accompanying drawings, which are incorporated in and constitute a part of this specification, illustrate embodiments of the invention and, together with a general description of the invention given below, serve to explain the principles of the invention.

DETAILED DESCRIPTION

Figure 1:
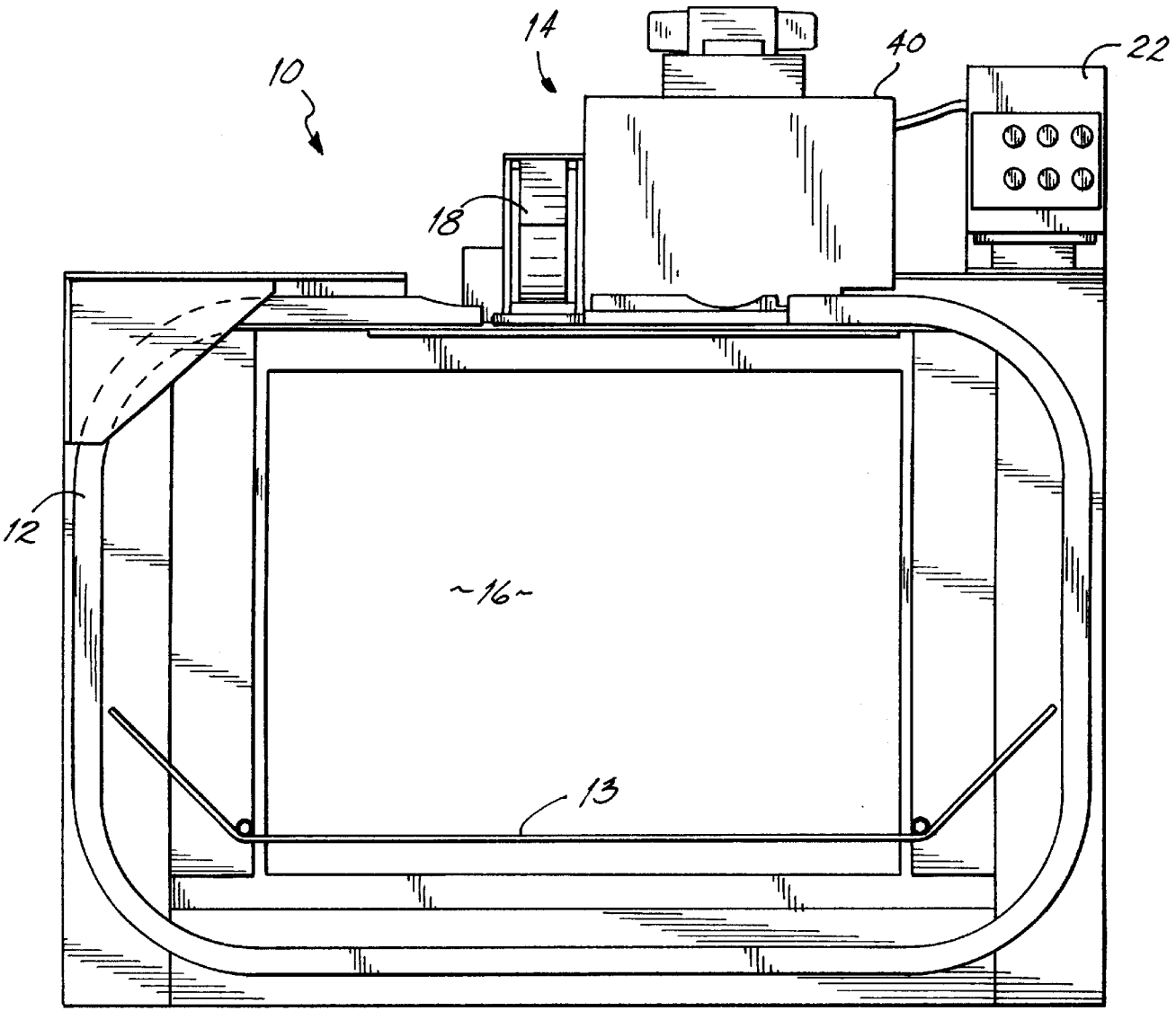
FIG. 1 is a front elevational view of a wire tieing system which may utilize the present invention.

FIG. 1 illustrates a front elevational view of a tieing system in which the invention may be incorporated. Specifically, tieing system 10 includes a wire guide track 12 and a tieing assembly 14. Track 12 includes a groove (not shown) and wire is directed therearound. A bale of material is directed into opening 16 which is encircled by track 12. The wire encircling the bale is engaged by the tieing assembly 14 and is tied to secure the bale together. A deflector shield 13 keeps bale material from clogging the track 12. Assembly 14 includes a tieing head 18 which engages the wires to twist ends of the wires together for tieing, and for securing the wire around the bale. A feed and tensioning structure (not illustrated) ensures that the wire is properly fed around the track 12 under sufficient tension to be engaged by tieing head 18. Controls 22 are utilized to control the system 10. System 10 will generally be utilized with a baling structure or baler, and the bale of material is pushed through opening 16 by the baler. A system, similar to system 10, is known in the art for wrapping and tieing wire around bales. For example, the Model 330 Wire-Tieing System is available from U.S. Wire-Tie Systems, a division of Leggett and Platt, Inc. of Carthage, Mo.

As mentioned above, the tieing head 18 and its associated parts may weigh several hundred pounds. When system 10 must be repaired or maintained, it may be necessary to remove the head or disassemble it, in part, to move the tieing head 18 to another position. Care must then be taken to prevent the heavy parts from moving or sliding while workers are repairing or maintaining a section of the system 10. Accordingly, the present invention may be utilized with tieing systems similar to system 10 illustrated in FIG. 1, or other suitable tieing systems.

Figure 2:
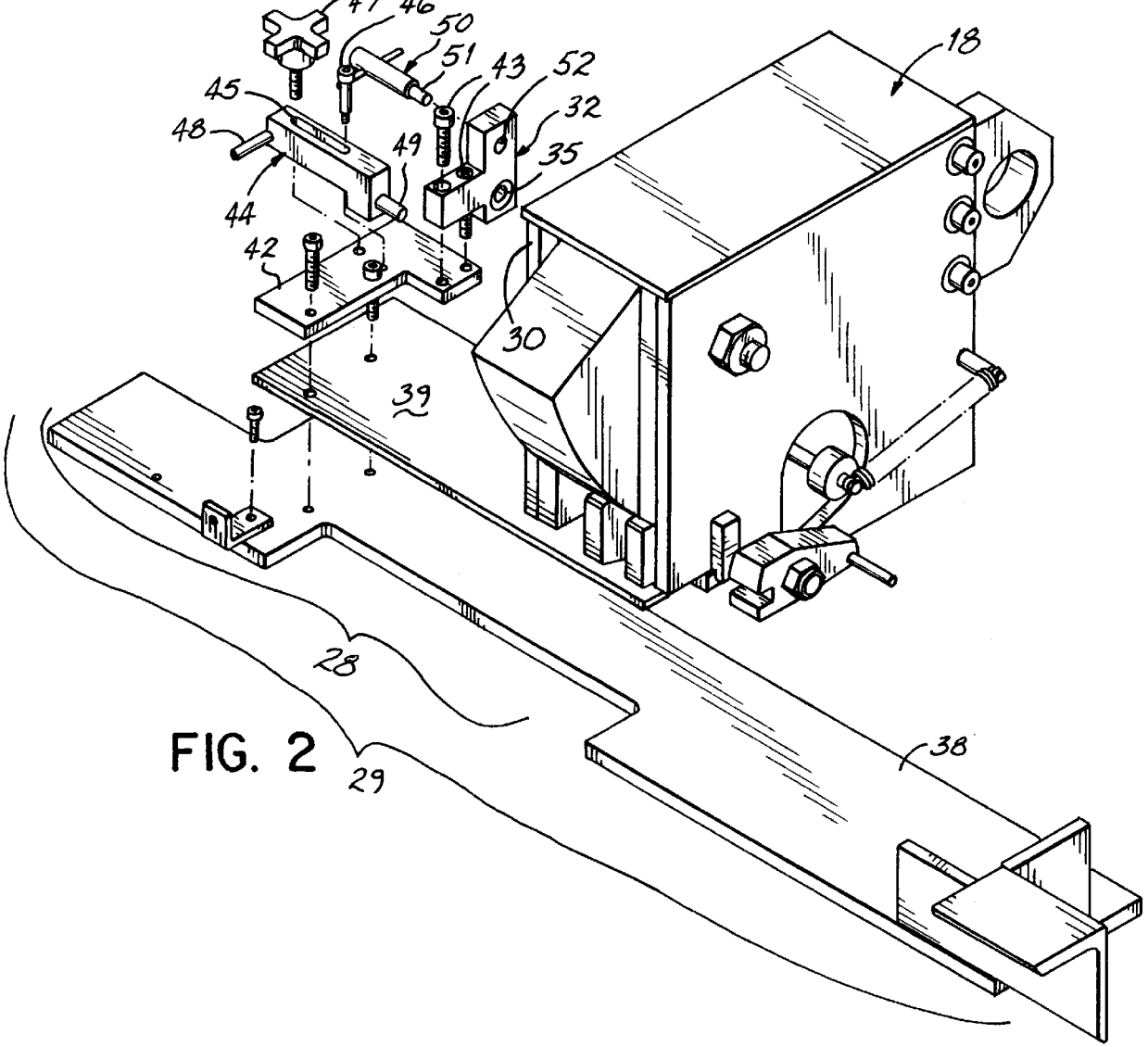
FIG. 2 is an exploded perspective view of one embodiment of the present invention.
Figure 3:
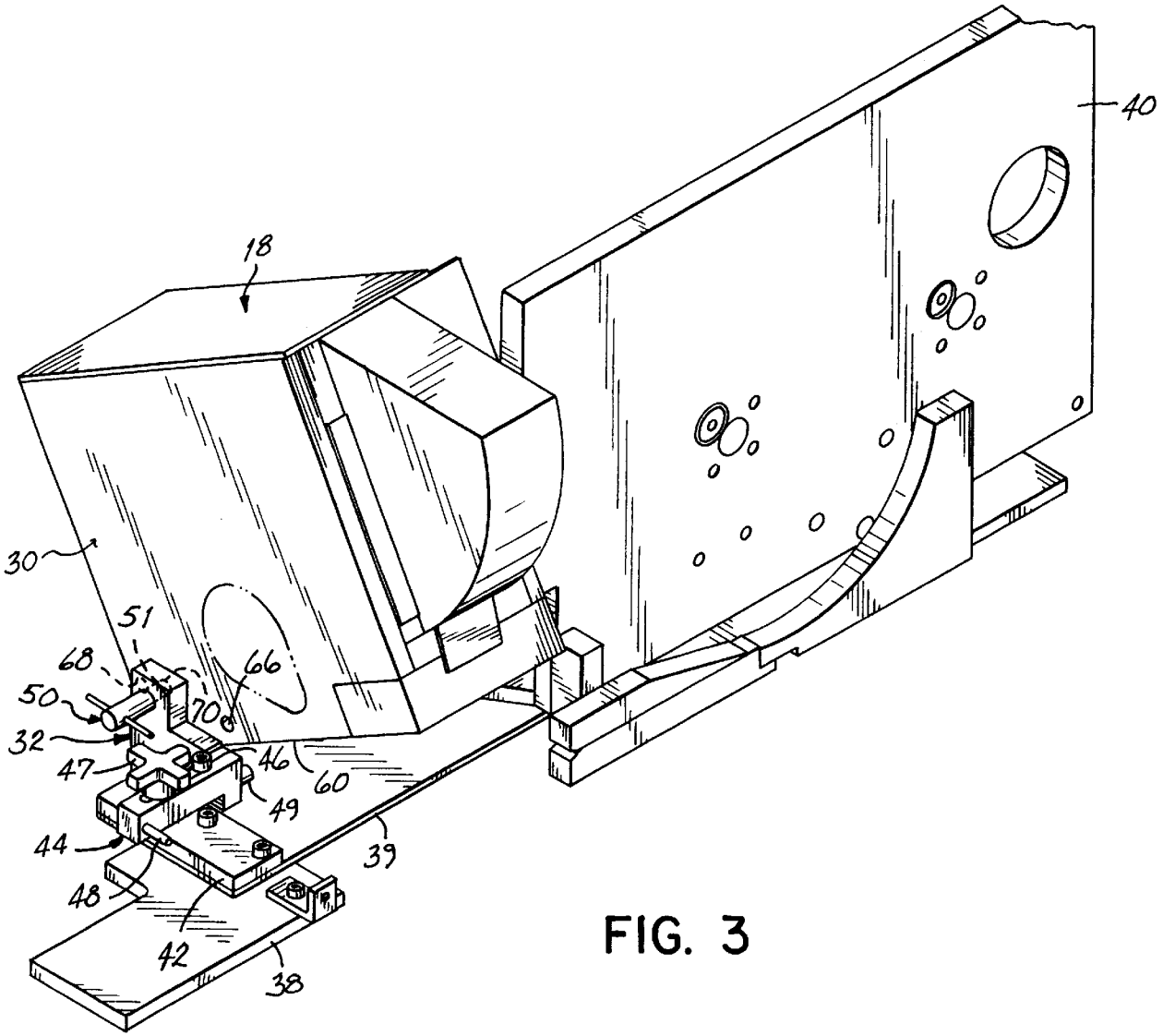
FIG. 3 is a perspective view of one embodiment of the present invention with the tieing head in the maintenance position.
Figure 4:
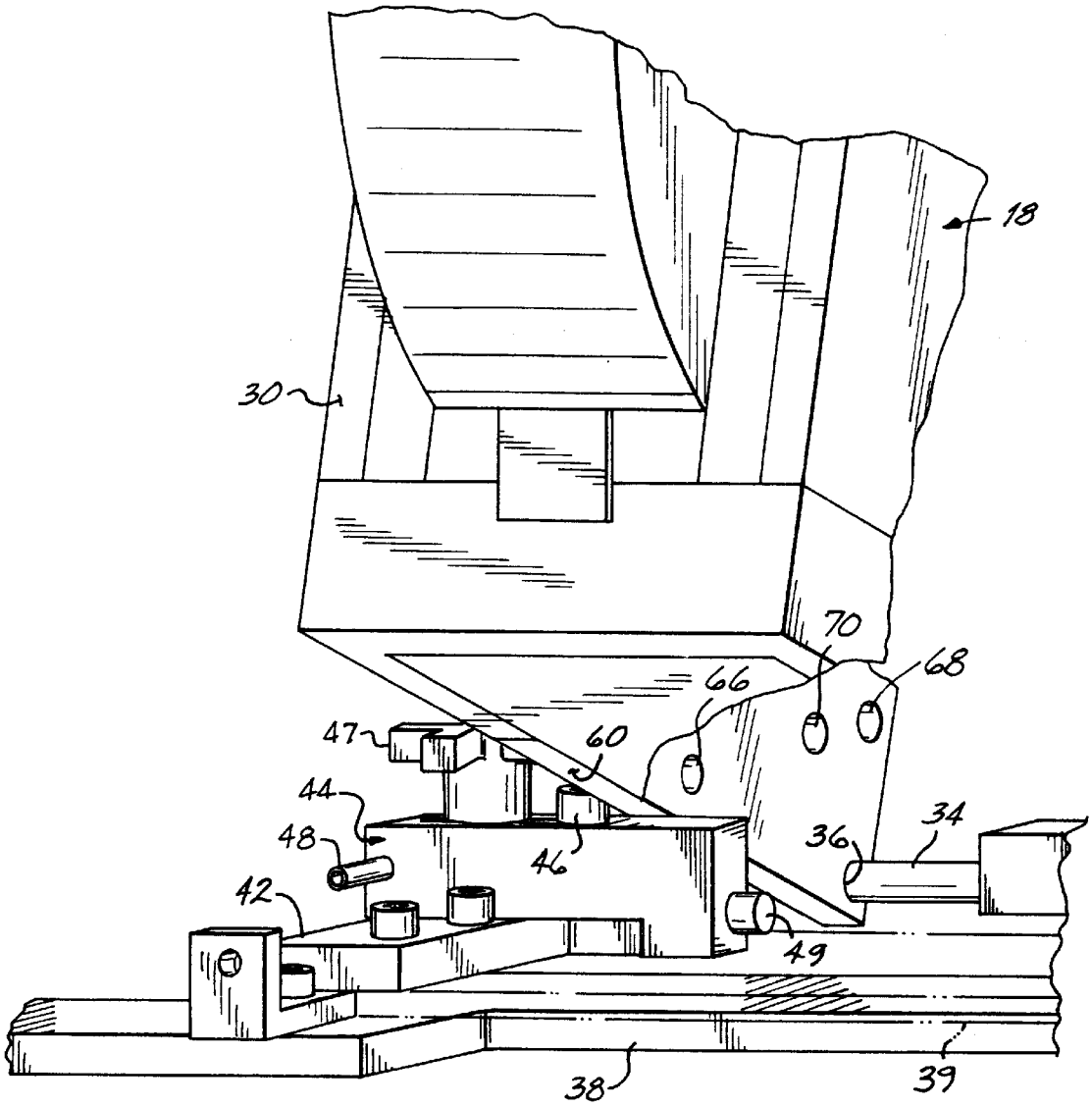
FIG. 4 is another perspective view of an embodiment of the present invention with the tieing head in the maintenance position.

Referring to FIG. 2, the tieing head 18 is shown, which is coupled with the inventive assembly as discussed further hereinbelow. Tieing head 18 is commercially available and is known in the art. Accordingly, the detail in the operation of such a tieing head is not discussed herein. Greater information regarding one suitable tieing head, such as for a Model 330 System, is available from U.S. Wire-Tie Systems of Carthage, Mo. Essentially, such a tieing head will grip tensioned wires wrapped around a bale, twist those wires, and cut the ends thereof so that the bale may be moved beyond the tieing system 10 for further processing. In the present invention, the tieing head 18 is coupled to a head pivot assembly 28 which allows head 18 to pivot between an operating position as shown in FIG. 1, and a maintenance position as shown in FIGS. 3 and 4. The head pivot assembly 28 and tieing head are collectively referred to herein as a tieing head assembly 29.

In accordance with one embodiment of the present invention, the tieing head 18 includes mounting plates 30. The plates 30 and head 18 are rotatably mounted and specifically are coupled to a pivot bracket 32 through an appropriate pivot pin 34 extending through hole 35 of bracket 32 and through a corresponding hole 36 in at least one of the plates 30.

Plates 30 and head 18 pivot with respect to a frame plate, or frame 38, and another mounting plate 39. Pivot bracket 32 is coupled to a pivot bracket mounting plate 42 by appropriate fasteners, such as bolts 43. Pivot bracket mounting plate 42 is, in turn, coupled to mounting plate 39 and frame 38 by appropriate bolts. Also coupled to the pivot bracket mounting plate 42 is a sliding support block 44 which is part of the head pivot assembly in accordance with another aspect of the present invention. Block 44 includes a guide groove 45 and is slidably coupled to plate 42. A guide groove bolt 46 and a bolt with attached hand knob 47 couple the sliding block 44 to the plate 42. A roll pin 48 is inserted into an appropriately formed aperture on one end of block 44, while a dowel pin 49 extends from an aperture at another end of the block, generally in line with the longitudinal axis of block 44 and perpendicular to roll pin 48.

A locating pin 50 is movably coupled with respect to pivot bracket 32 through an aperture 52 formed therein. In accordance with one aspect of the present invention, the locating pin 50 and support block 44 cooperate to secure the head 18 in a down, or operating, position when the tieing system is being utilized and to alternately secure the head 18 in an upward, or maintenance, position when repair or maintenance is necessary with respect to the head or another portion of the tieing system proximate the head. To that end, plate 30 and head 18 may be pivoted appropriately on an axis defined by pivot pin 34 so that the head may be moved out of its operating position, as illustrated in FIGS. 3 and 4. In one embodiment of the invention, plate 30 and head 18 may pivot in the range of approximately 30° from the horizontal plane defined by frame plate 38. Of course, other angular ranges of motion for head 18 may be chosen in accordance with the principles of the invention.

The locating pin 50 is preferably spring loaded in bracket 32. The pin 50 is biased toward head 18 and apertures in plate 30 (see FIG. 4). In that way, the pin will automatically engage head 18 when the pin is aligned with one of apertures 68, 70. A maintenance or repair person is free to lift the heavy head 18 with both hands and the pin will automatically lock the head in the maintenance position. The person is then free to slide block 44 underneath the head as discussed further hereinbelow.

Referring to FIG. 3, when it is necessary to repair or maintain head 18 or a particular part of the wire tieing system 10 proximate head 18, the head 18 may be pivoted upwardly from the horizontal plane defined by frame plate 38. As shown in FIG. 3, tilting head 18 in such a way exposes the bottom of the head and other areas below the head which a maintenance person may need to access. As noted above, head 18 and its associated hardware is heavy and thus maintaining the head in the upwardly pivoted or rotated maintenance position is important. To that end, in accordance with one aspect of the present invention, the sliding support block 44 slides on the pivot bracket mount plate 42 and specifically slides beneath the bottom edge 60 of plate 30 (see FIG. 3). Block 44 is formed of a suitable metal, such as steel, for supporting the weight of plate 30 and head 18. Block 44 acts as a physical support wedge between plate 39 and head 18 with respect to pivot pin 34 to prevent the head 18 and plate 30 from pivoting downwardly and back to the operating position. In that way, a maintenance person may work beneath head 18 safely and comfortably without having to physically hold the head 18 in the upwardly pivoted maintenance position. Roll pin 48 may be gripped and utilized to slide block 44 back and forth beneath head 18. The hand knob 47 and bolt associated therewith must be loosened in order for block 44 to slide. After the block 44 has been slid under head 18, the hand knob 47 and bolt may be again tightened to maintain the block 44 in its wedge, or support, position, as illustrated in FIGS. 3 and 4.

As noted above, locating pin 50 will automatically engage the head 18 when it is lifted. First, the pin 50 must be pulled away from head 18 and out of aperture 68 to disengage the head. Then the head is free to pivot. It may then be pivoted to allow the pin 50 to align with aperture 70 to lock the head in the maintenance position. After that, the block 44 may be slid underneath head 18.

The block 44 is positioned appropriately for maintaining and supporting the head 18 at a suitable angular position above a horizontal operating position. One suitable angle is in the range of 30°, although other angles may be utilized. Furthermore, the operating position of head 18 may not be generally horizontal. It is desirable, in accordance with the principles of the present invention, to be able to move head 18 sufficiently above its operating position to allow easy access to the head and head assembly for easier repair and maintenance.

When the block 44 has been slid from beneath plate 30 and the head 18 has been allowed to pivot back to the operating position, block 44 may then be slid toward plate 30 again so that dowel pin 49 engages a corresponding opening 66 in plate 30 to secure the head 18 in the operating position. That is, dowel pin 49 on block 44 engages aperture 66 to hold the plate 30 and head 18 in the downwardly pivoted operating position (see FIG. 4.). For repair or maintenance, block 44 is again slid away from head 18 to disengage pin 49 from aperture 66 so that head 18 may be pivoted upwardly to the maintenance position. Then, sliding the block 44 toward head 18 will allow the block to slide under the head to again hold it in an upwardly pivoted maintenance position as illustrated in FIGS. 3 and 4.

In accordance with another aspect of the present invention, the locating pin 50 is also utilized to further secure head 18 in the downwardly pivoted or operating position, or the upwardly pivoted or maintenance position. Plate 30 includes at least two apertures 68, 70 positioned proximate locating pin 50, as illustrated in FIG. 4. It will be readily understood by a person of ordinary skill in the art that additional apertures might be utilized for an additional angular range of pivoting. However, for the purposes of illustrating one embodiment of the invention, apertures 68 and 70 are illustrated. The apertures 68, 70 are positioned along an arc which corresponds to the pivot arc defined by pivot pin 34 and its associated axis. When head 18 is in the downwardly pivoted, or operating position, locating pin 50 engages aperture 68 to further hold the head 18 in the operating position. When head 18 has been pivoted upwardly, as illustrated in FIGS. 3 and 4, the locating pin has been withdrawn to allow the plate 30 to rotate, and is then subsequently inserted (automatically or otherwise) into aperture 70 which corresponds with the head being in its upwardly pivoted position. That is, locating pin 50 is aligned with aperture 70 when the head 18 is pivoted upwardly. In that way, the pivoting head 18 is further locked in the upwardly pivoted maintenance position so that a maintenance person may safely work beneath the head 18 without having to hold the heavy components in the upwardly pivoted position. The end 51 of pin 50 is appropriately formed to engage the apertures 68, 70.

That is, the present invention utilizes multiple securing structures for maintaining the head in the upwardly pivoted or maintenance position and also in retaining the head 18 in the downwardly pivoted or operating position. While locating pin 50 may be sufficient by itself for maintaining head 18 in the upwardly pivoted position, block 44 provides a physical block or wedge to provide cumulative structures to maintain the heavy tieing head 18 in the upwardly pivoted position as illustrated in FIGS. 3 and 4. To drop head 18, block 44 is slid away from plate 30 while locating pin 50 is pulled out of the aperture 70. Once the plate 30 and head 18 have pivoted downwardly to the operating position, block 44 may again be slid toward head 18 so that pin 49 engages aperture 66 and the locating pin 50 may be moved to engage aperture 68. In that way, the head 18 is locked in the operating position to prevent inadvertent upward pivoting of the head during a tieing procedure.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A wire tieing system for wrapping and tieing a bale of material with wire, the system comprising:

a wire guide for guiding a wire around a bale of material;

a tieing head configured for receiving portions of a wire in the guide and securing the portions together to thereby tie the wire and therefore tie a bale of material;

the tieing head being pivotable with respect to said wire guide, the tieing head operable for being pivoted between an operating position proximate the guide and a maintenance position away from the guide;

a head pivot assembly for maintaining the tieing head in the maintenance position, the head pivot assembly comprising a support block which is operably movable to engage a portion of the tieing head when the tieing head is pivoted to the maintenance position to prevent the head from pivoting back to the operating position.

2. The wire tieing system of claim 1 wherein said support block is slidably mounted, the support block being slidable underneath a portion of said tieing head to prevent the head from pivoting back to the operating position.

3. The wire tieing system of claim 2 wherein said tieing head has a bottom edge, the support block being slidable underneath said bottom edge so that the tieing head rests on the support block and is therefore prevented from pivoting back to the operating position.

4. The wire tieing system of claim 1 wherein said support block further comprises a pin, the tieing head including an aperture, the support block pin being operable to engage the aperture when the tieing head is in the operating position to prevent the head from being pivoted to the maintenance position.

5. The wire tieing system of claim 1 further comprising a locating pin operably mounted to engage the tieing head in the maintenance position and to further prevent the tieing head from pivoting back to the operating position.

6. The wire tieing system of claim 5 wherein said locating pin is spring loaded to automatically engage the tieing head when it is pivoted to the maintenance position.

7. The wire tieing system of claim 6 wherein said tieing head includes a maintenance aperture, the locating pin movable for sliding into the maintenance aperture when the tieing head is in the maintenance position to further prevent the head from pivoting to the operating position.

8. The wire tieing system of claim 6 wherein said tieing head includes an operating aperture, the locating pin movable for sliding into the operating aperture when the tieing head is in the operating position to secure the head in the operating position and to prevent the head from pivoting to the maintenance position.

9. The wire tieing system of claim 1 wherein said support block includes a securing mechanism for securing the support block when it is in engagement with said tieing head.

10. A wire tieing system for wrapping and tieing a bale of material with wire, the system comprising:

a wire guide for guiding a wire around a bale of material;

a tieing head configured for receiving portions of a wire in the guide and securing the portions together to tie the wire and therefore tie a bale of material;

the tieing head being pivotable with respect to said wire guide, the tieing head operable for being pivoted between an operating position proximate the guide and a maintenance position away from the guide;

a head pivot assembly for maintaining the tieing head in the maintenance position, the head pivot assembly comprising a locating pin which is operably movable to engage a portion of the tieing head when the tieing head is pivoted to the maintenance position to prevent the head from pivoting back to the operating position.

11. The wire tieing system of claim 10 wherein said tieing head includes a maintenance aperture, the locating pin movable for sliding into the maintenance aperture when the head is in the maintenance position to further prevent the head from pivoting to the operating position.

12. The wire tieing system of claim 10 wherein said tieing head includes an operating aperture, the locating pin movable for sliding into the operating aperture when the tieing head is in the operating position to secure the head in the operating position.

13. The wire tieing system of claim 10 further comprising a support block, the support block being slidable underneath a portion of said tieing head to prevent the head from pivoting back to the operating position.

14. The wire tieing system of claim 13 wherein said support block further comprises a pin, the tieing head including an aperture, the support block pin being operable to engage the aperture when the tieing head is in the working position to prevent the head from being pivoted to the maintenance position.

15. The wire tieing system of claim 13 wherein said support block includes a securing mechanism for securing the support block when it is slid underneath a portion of said tieing head to prevent it from pivoting to the operating position.

16. A wire tieing system having a tieing head assembly for tieing a bale of material with wire, the system comprising:

a tieing head assembly which is pivotable between an operating position for tieing wire and a maintenance position away from the operating position for maintaining and repairing the tieing head;

a head pivot assembly comprising a support block which is slideable underneath a section of said pivotable tieing head assembly, when the tieing head is in the maintenance position, for preventing the tieing head from pivoting to the operating position.

17. The wire tieing system of claim 16 wherein said support block further comprises a pin, the tieing head assembly including an aperture, the support block pin being operable to engage the aperture when the tieing head is in the operating position to prevent the head from being pivoted to the maintenance position.

18. The wire tieing system of claim 16 further comprising a locating pin operably mounted to engage a portion of the tieing head assembly when the pivotable tieing head in the maintenance position to further prevent the tieing head from pivoting to the operating position.

19. The wire tieing system of claim 18 wherein said tieing head assembly includes a maintenance aperture, the locating pin movable for sliding into the maintenance aperture when the tieing head is in the maintenance position to further prevent the tieing head assembly from pivoting to the operating position.

20. The wire tieing system of claim 19 wherein said tieing head assembly includes an operating aperture, the locating pin movable for sliding into the operating aperture when the tieing head is in the operating position to secure the tieing head in the operating position and to prevent it from pivoting.

* * * * *